United States Patent [19]

Mazzorana

[11] Patent Number: 4,553,442

[45] Date of Patent: Nov. 19, 1985

[54] STARTER FOR HEAT ENGINE COMPRISING A REINFORCED SUPPORT

[75] Inventor: Alfred B. Mazzorana, Venissieux, France

[73] Assignee: Societe Paris-Rhone, Lyons, France

[21] Appl. No.: 494,846

[22] Filed: May 16, 1983

[30] Foreign Application Priority Data

May 18, 1982 [FR] France ..... 82 08981

[51] Int. Cl.[4] ..... F02N 15/06

[52] U.S. Cl. ..... 74/7 A; 29/526 R; 74/6; 74/7 R; 123/179 M; 290/48; 310/43; 310/89; 403/12; 403/408.1

[58] Field of Search ..... 74/6, 7 R, 7 A, 606 R; 29/526 R; 123/179 M; 411/908; 403/12, 408; 310/43, 89; 290/38 R, 48

[56] References Cited

U.S. PATENT DOCUMENTS

| | | | |
|---|---|---|---|
| 2,839,935 | 6/1958 | Hartzell et al. | 74/6 |
| 3,089,344 | 5/1963 | Lafitte | 74/6 |
| 3,444,402 | 5/1969 | Cartier | 310/43 X |
| 3,745,854 | 7/1973 | Haag et al. | 74/606 R |
| 4,289,061 | 9/1981 | Emmett | 411/908 |
| 4,330,727 | 5/1982 | Oudet | 310/43 X |
| 4,384,224 | 5/1983 | Spitler et al. | 310/43 X |

OTHER PUBLICATIONS

Translation of French Patent Application No. 81 03698-1981.

*Primary Examiner*—Allan D. Herrmann
*Attorney, Agent, or Firm*—Dowell & Dowell

[57] ABSTRACT

The invention relates to an improved starter for an internal combustion engine comprising a reinforced support made of plastic or metal which is not fully rigid. A metal shell covers the nose element of the support so that said shell absorbs the stresses to which the support is subjected. The shell comprises a flange which is fixed to the base plate of the starter by the screws which mount the starter to the casing of the engine. For this purpose, bushings are disposed between the flange of the shell and the metal base plate of the starter so that the non-rigid support is not subjected to the compressive stresses exerted by the screws. The invention is more particularly applicable to the automobile industry.

6 Claims, 7 Drawing Figures

STARTER FOR HEAT ENGINE COMPRISING A REINFORCED SUPPORT

The present invention relates to a starter for an internal combustion engine having a reinforced non-rigid support.

Starters for engines generally comprise a support incorporating a nose element which carries the end bearing of the shaft of its motor along which the pinion actuator moves. In the majority of cases, this support is provided with lugs for fixing the starter on the casing of the engine.

The nose element in question is naturally subjected to considerable stresses resulting from vibrations of the engine and to those generated by jolts from the road. More particularly, the support receives the forces due to the rotation of the engine by the pinion of the actuator. Under these conditions, the nose element must provide a considerable rigidity, the material constituting it having to be chosen with care. This material is consequently expensive and increases the cost price of the whole.

It is an object of the improvements according to the present invention to produce a support for the starter of an engine, which is made of a less rigid material.

According to the invention, means are provided for reinforcing said support in the region of its nose element.

The invention will be more readily understood on reading the following description with reference to the accompanying drawings, in which.

Figure 1:
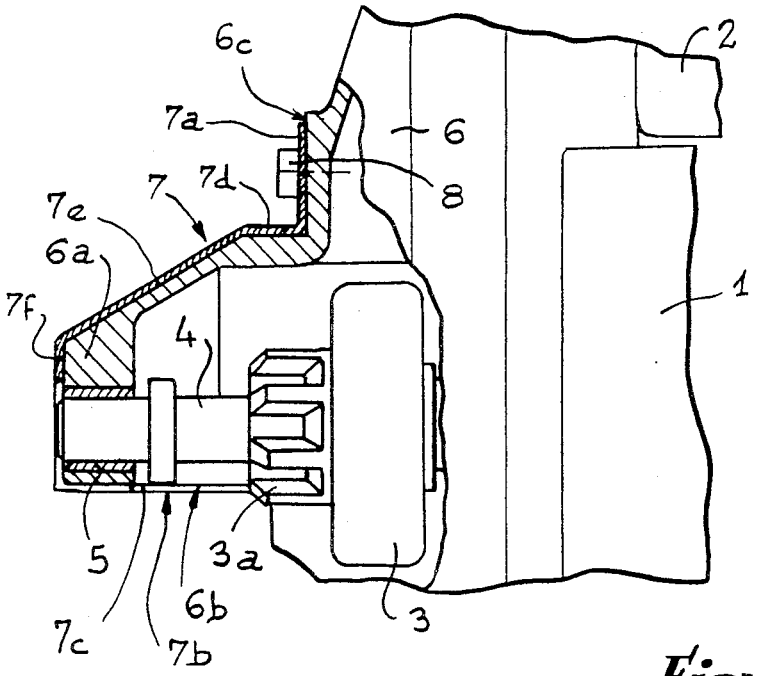
FIG. 1 is a partial view, with parts broken away, of a starter for an engine incorporating the improvements according to the invention.

Referring now to the drawings, the partial view of FIG. 1 shows the main elements of an electric starter for internal combustion engine comprising an electric motor 1, a relay contactor 2 for actuating an actuator 3 adapted to move along a shaft 4 so that the pinion 3*a* of said actuator comes into mesh with the ring gear (not shown) of the internal combustion engine. It will be noted that the end of the shaft 4 pivots in a bearing 5 borne by the nose element 6*a* of a support 6 on which the motor 1 and the contactor 2 are assembled. The nose element 6*a* is conventionally in the form of a hollow cone intersected by a plane, FIG. 5 which defines an opening 6*b* adapted to allow axial passage of the pinion 3*a* when it moves.

According to the invention, the support 6 is made of a non-rigid material such as cast aluminium or a plastics material, the forces transmitted to this support at its nose element 6*a* being absorbed by a reinforcing shell 7 which covers said nose element.

Deformations of the nose element which might result in the formation of cracks are prevented by the presence of said shell, which includes a flange 7*a* applied against a shoulder 6*c* of the support 6, this flange having holes in which engage assembly screws 8 which cooperate with the support 6.

The shape of the shell is similar to that of the nose element 6*a*, so that said shell includes a cut-out 7*b* corresponding to the opening 6*b* of the support. In a preferred embodiment of the invention, the cut-out 7*b* of the shell is provided with a raised edge 7*c* which abuts against the support 6 along the edges of the opening 6*b*.

Figure 2:
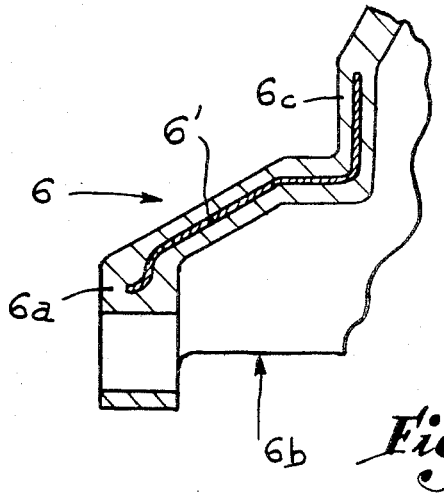
FIG. 2 is a partial view similar to that of FIG. 1, but illustrating a modification of a nose thereof.

In a modification, the shell may constitute an insert (6') over which the support 6 may be moulded, its truncated part being embedded in the thickness of the nose element 6*a* and its flange located inside the partition constituting the shoulder 6*c* (FIG. 2).

Figure 3:
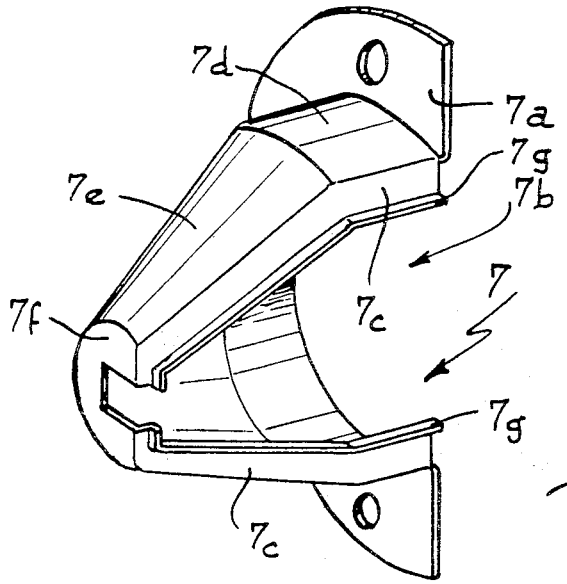
FIG. 3 shows in perspective a shell according to the invention.

FIG. 3 illustrates a preferred embodiment of the shell. It is formed by the flange 7*a*, a wall 7*d* perpendicular to said flange and a truncated cone part 7*e* terminating in a transverse partition 7*f* parallel to the plane of said flange.

Figure 4:
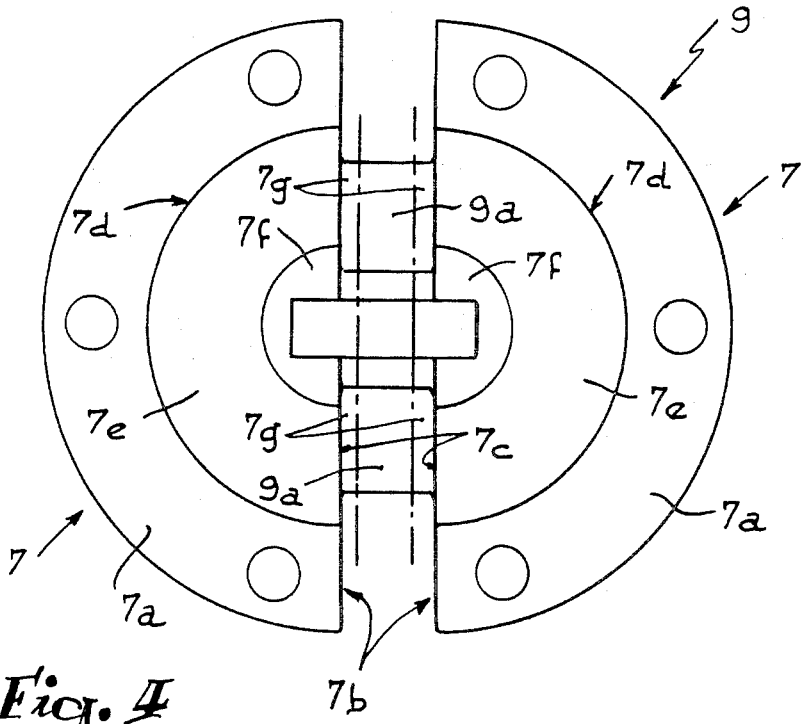
FIG. 4 is an end elevation which shows the stamped piece from which two shells are made.

For the purpose of saving material, a stamped piece 9, illustrated in FIG. 4, is used for forming two shells at a time by each stamping operation.

The stamped piece 9 comprises two complete shells 7 facing each other and connected by two partitions 9*a* perpendicular to the plane of the raised edges 7*c* FIG. 3. Once the stamped piece 9 has been made, each partition 9*a* is cut out along two lines illustrated in discontinuous lines so that only a minimum flange 7*g* is left on each raised edge 7*c* (FIG. 3).

Figure 5:
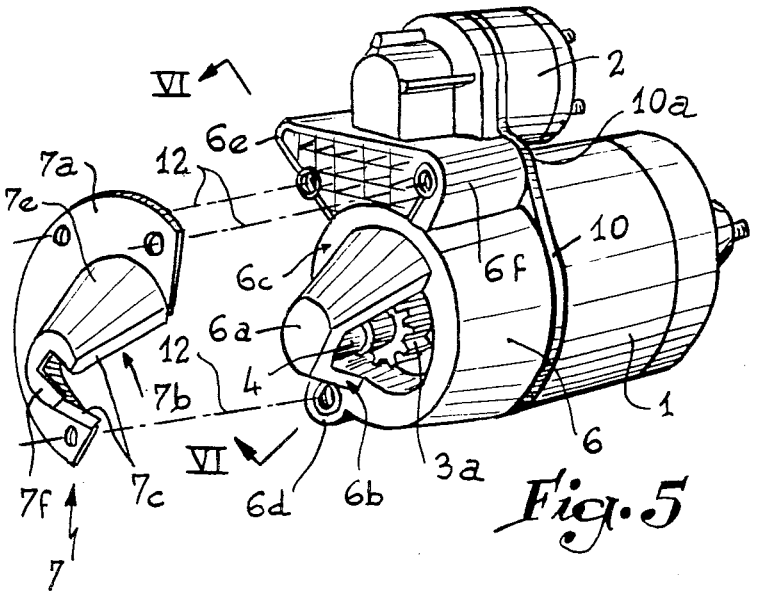
FIG. 5 is a partially exploded view in perspective of a starter comprising a reinforcing shell applied on a support made of plastics material.

FIG. 5 illustrates a starter for an internal combustion engine of the type such as described in Applicants' French patent application No. 81 03698 and which comprises a base plate 10 provided with lugs 10*a* located opposite mounting lugs 6*d*, 6*e*, 6*f* of the support 6, so that these mounting lugs are compressed between the base plate 10 and the casing of the combustion engine (not shown). As indicated in the prior art document, the support 6 is subjected to no other force than that of compression at the locations of its mounting lugs.

Figure 6:
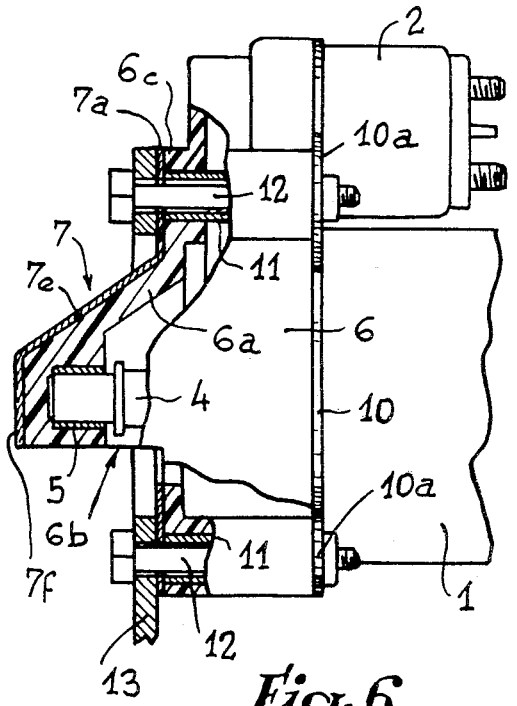
FIG. 6 is a partial side view on a larger scale with parts broken away, along line VI—VI (FIG. 5).

In each embodiment illustrated in the relevant Figure, the support 6 is made of a moulded plastics material so that it cannot absorb compressive forces without deformation. Under these conditions, the present structure disposes bushings 11 (FIG. 6) between the flange 7*a* of the shell 7 and the base plate 10. In this way, the support 6 is not subjected to any compressive force at the mounting location of the starter on the casing 13 of the engine due to screws 12 which pass through the bushings. The other stresses absorbed by the support 6 are transmitted to the shell 7 so that said support can be made of a moulded plastics material not presenting high rigidity.

Figure 7:
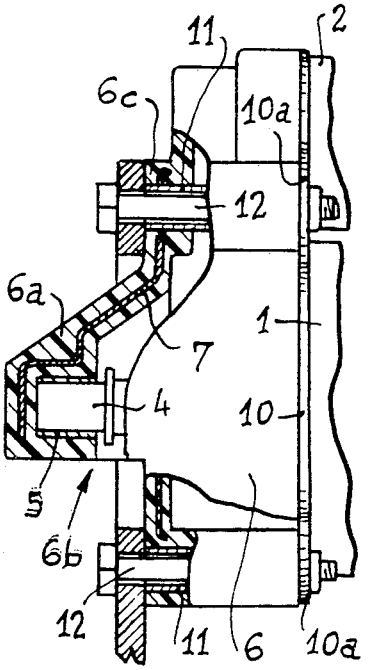
FIG. 7 is a view similar to that of FIG. 6, but illustrating a modification in which the shell constitutes an insert over and around which the support is moulded.

In the embodiment of FIG. 7, the shell 7 is made in the form of an insert as in the case of FIG. 2, but, there again, it is a plastics material 6 which is moulded over this insert. Under these conditions, and in order to avoid any compression of the support 6, bushing 11 are provided between the casing 13 of the engine and the base plate 10.

Due to the invention, it is therefore possible to make the support of an internal combustion engine starter from a moulded plastics material.

It must be understood that the foregoing description has been given only by way of example and that it in no way limits the domain of the invention which would not be exceeded by replacing the details of execution described by any other equivalents. In particular, the motor of the starter may be of the hydraulic, pneumatic, etc. . . . type.

What is claimed is:

1. A starter assembly for mounting to the casing of an engine, the assembly including an electric motor having an axial shaft for extending through an opening in the casing and the shaft supporting a starter pinion moveable thereon to an engaged position, and the assembly including relay contactor means operative to move the pinion on the shaft, the starter assembly further comprising:

a metal base plate fixed to the motor and the contactor and having an axial opening through which the shaft extends;

a support member made of material which is less than fully rigid, the support member being disposed against the plate and having a shoulder disposed to abut the casing at its opening and having an axial opening to receive the shaft and pinion, and the support member having a nose portion carrying a bearing supporting the motor shaft and having a transverse opening opposite the pinion when in said engaged position;

a metal reinforcing shell shaped to cover and closely fit said nose portion and having a transverse cut-out registering with the transverse opening of the nose portion, and having a flange shaped to lie against said shoulder portion and against said casing; and the plate and the support member and the shell flange and the casing having multiple aligned screw holes, and the assembly having mounting screws extending through the holes and mounting the assembly to the engine.

2. The starter assembly as claimed in claim 1, wherein the screw holes passing through the material of the support member are of enlarged diameter greater than the diameters of the holes through the shell flange and the base plate, and the assembly further including metal bushings in said enlarged holes and shaped to abut the shell flange and the base plate and support the compressive forces of the mounting screws.

3. The starter assembly as claimed in claim 1, wherein said transverse opening of the support member is defined by edges of its nose portion, and said shell has reinforcing means abutting against and supporting the nose portion at said edges.

4. The starter assembly as claimed in claim 3, wherein said reinforcing means comprise bent edges of the metal shell which are disposed to closely overlie the edges of the transverse opening of the nose portion and support it against stresses caused by vibration and during rotation of the starter.

5. The starter assembly as claimed in claim 4, wherein said shell comprises an integral sheet metal stamping including said flange and a nose portion having said cut-out with integrally formed edges raised around the cut-out and bent at right angles to the nose portion.

6. The starter assembly as claimed in claim 4, wherein said reinforcing shell comprises a sheet metal stamping formed of two opposed shells each including a flange, a nose portion having a cut-out and integrally formed edges rasised around the cut-out, two of said shells being stamped side-by-side from a single sheet of metal and joined by partition means joining them together at the raised edges.

* * * * *